US005335402A

United States Patent [19]

Semon

[11] Patent Number: 5,335,402

[45] Date of Patent: Aug. 9, 1994

[54] BURIAL CASKET STATIONERY HARDWARE BAR SECUREMENT

[75] Inventor: Joseph R. Semon, Clarks Summit, Pa.

[73] Assignee: Casket Shells, Inc., Eynon, Pa.

[21] Appl. No.: 895,778

[22] Filed: Jun. 9, 1992

[51] Int. Cl.[5] ..... A61G 17/00

[52] U.S. Cl. ..... 27/2; 27/10; 27/27; 16/112

[58] Field of Search ..... 27/2–10, 27/27; 16/112

[56] References Cited

U.S. PATENT DOCUMENTS

| | | | |
|---|---|---|---|
| 2,106,695 | 1/1938 | Larson | 27/10 |
| 2,670,497 | 3/1954 | Rowe | 16/112 |
| 4,077,096 | 3/1978 | Christian | 27/2 |
| 5,008,990 | 4/1991 | Craft | 27/2 |

*Primary Examiner*—Carl D. Friedman
*Assistant Examiner*—Kien Nguyen
*Attorney, Agent, or Firm*—Kane, Dalsimer, Sullivan, Kurucz, Levy, Eisele & Richard

[57] ABSTRACT

A casket is provided with a stationary hardware system for coupling bars to the sides of the casket such that no load is carried by decorative hardware when lifting the casket with the bars. Each system includes a block for attachment to the side of the casket and a clamp for embracing the bar. Camming surfaces on the block cooperate with surfaces on the clamp to tighten the grip of the clamp about the bar upon tightening a bolt and nut assembly that couples the clamp and block to the casket side.

9 Claims, 3 Drawing Sheets

BURIAL CASKET STATIONERY HARDWARE BAR SECUREMENT

BACKGROUND OF THE INVENTION

The bars or handles on a burial casket in addition to serving a decorative purpose, are utilized during a burial service by pall bearers to lift the casket and transport it to the desired location either during the pre-burial service or to the place of burial. In this regard, the casket, with the body of the deceased, may weigh several hundred pounds, so that the bars may prove necessary to assist the pall bearers in moving the casket. These bars normally are held by a series of arms or brackets connected to the sidewalls of the casket. Burial casket bars of this type are generally a straight tubular member which extends from near one end to near the other end of each side of the burial casket. The arms which constitute the hardware for the bar could either be stationery or swing bar hardware. Typical prior art swing bar hardware is disclosed in U.S. Pat. Nos. 3,204,286 and 4,615,085.

As an example, stationery hardware for bars have assumed the form shown in FIGS. 1 and 2 in which lugs and corners, with anywhere from two to four sheet metal screws, attach each part to the casket. Normally anywhere from 24 to 48 screws are deployed per casket for such hardware. Slots in the lugs and corners serve to support the bar. In this prior arrangement, the corners, lugs and sheet metal screws support and bear the load.

Prior art hardware systems of the foregoing type have proven to be of questionable safety, utilize a large number of parts, labor intensive and require relatively expensive and costly tooling. In such system, hardware in the form of lugs and corners form a supporting function as well as provide the desired ornamental and aesthetic affects on the exterior of the casket.

SUMMARY OF THE INVENTION

A principle object of the present invention is to provide a stationery hardware bar securement system that is safer, utilizes less parts and requires less costly tooling while permitting the hardware providing the decorative function to be interchangeable to satisfy customer needs and desires.

These and other objects of the invention are achieved by utilizing a one bolt system to secure non decorative stationery bar hardware to caskets. In this system, the bars, hardware and the bolts are the major load bearing components. Decorative pieces and decorative, non load bearing lugs on the corners, on the other hand, become ornamental parts that could simply be made to snap on and off so that other styles could be used interchangeably with the same hardware.

BRIEF DESCRIPTION OF THE DRAWINGS

The objects and advantage of the present invention will become apparent from the following detailed description of the preferred embodiment which is to be taken in connection with the accompanying drawings in which like numerals designate like parts, and in which.

DETAILED DESCRIPTION OF THE PREFERRED EMBODIMENTS OF THE INVENTION

Figure 1:
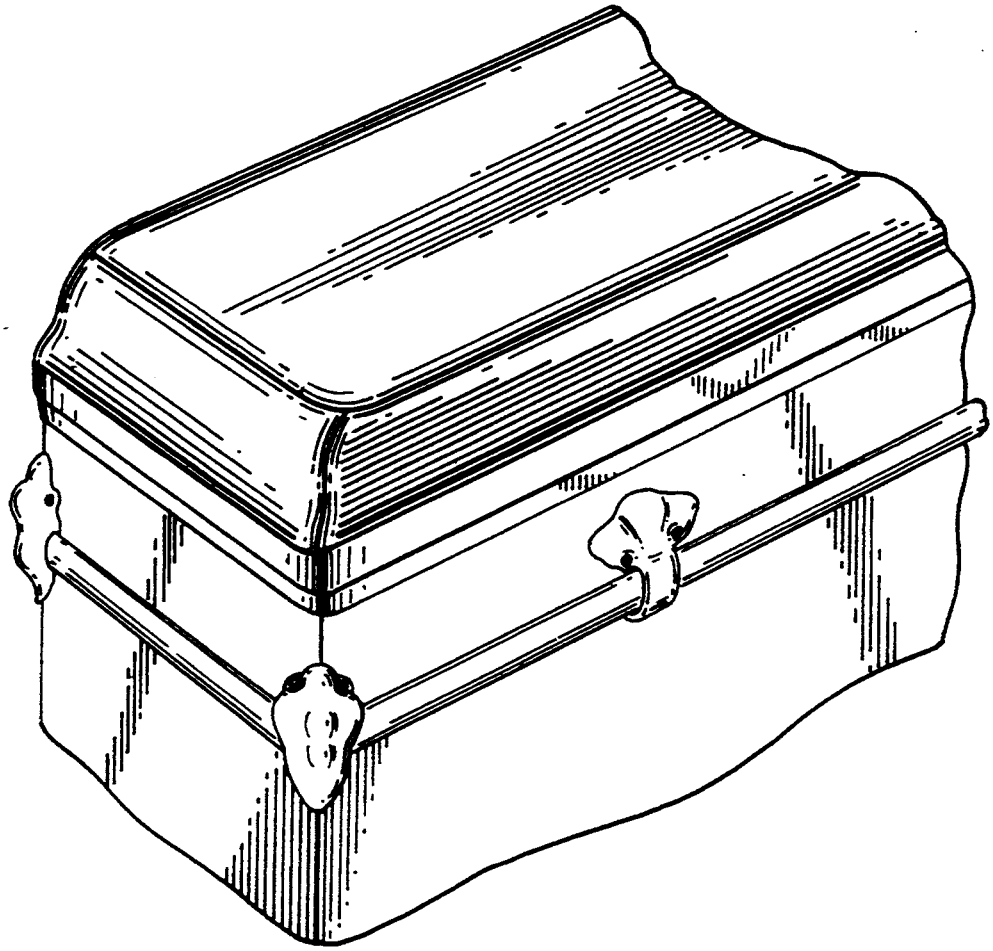
FIG. 1 PRIOR ART
FIG. 1 is a fragmentary perspective view of a casket utilizing a prior art stationery hardware bar system.
Figure 2:
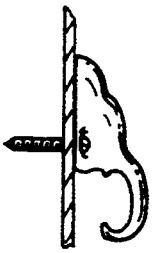
FIG. 2 PRIOR ART
FIG. 2 is a fragmentary sectional view of the supporting lug for the bar.
Figure 3:
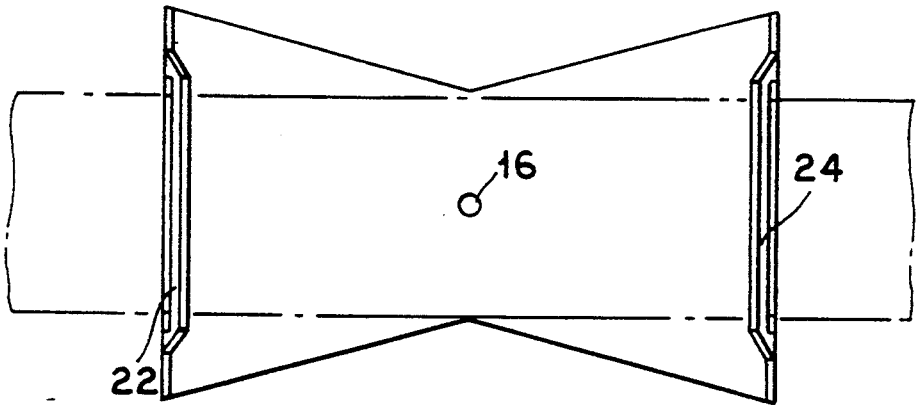
FIG. 3 is an exploded perspective view of the bar supporting hardware of the present invention for a stationery bar.
Figure 4:
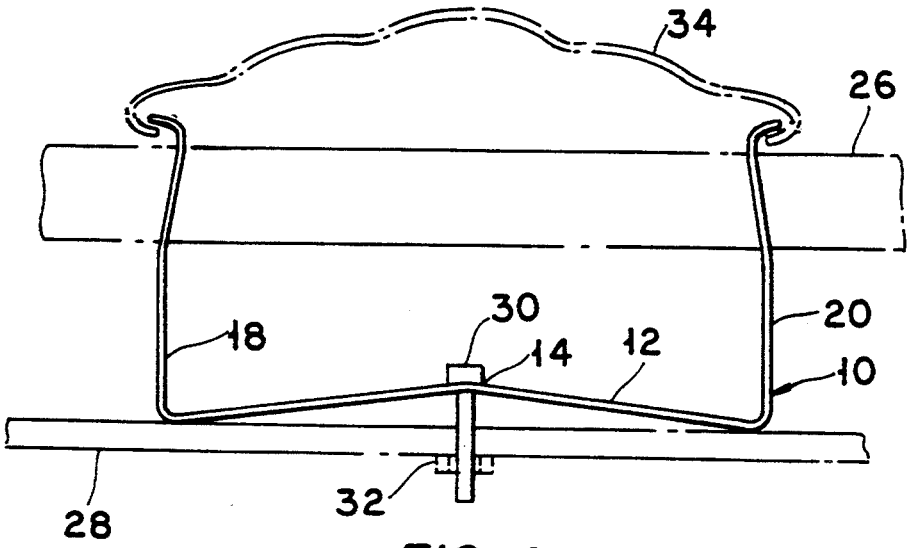
FIG. 4 is a cross-sectional view of the supporting hardware prior to the tightening of the bolt.
Figure 5:
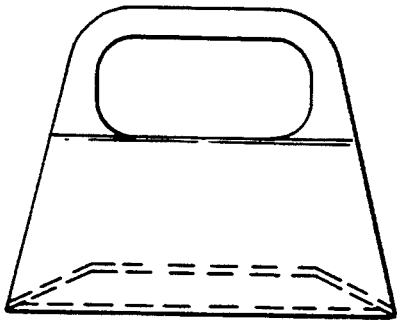
FIG. 5 is a cross-sectional view of the supporting hardware assembled by tightening the bolt and connected to the sidewall of a casket shown in phantom with the outer decorative hardware also shown in phantom.
Figure 6:
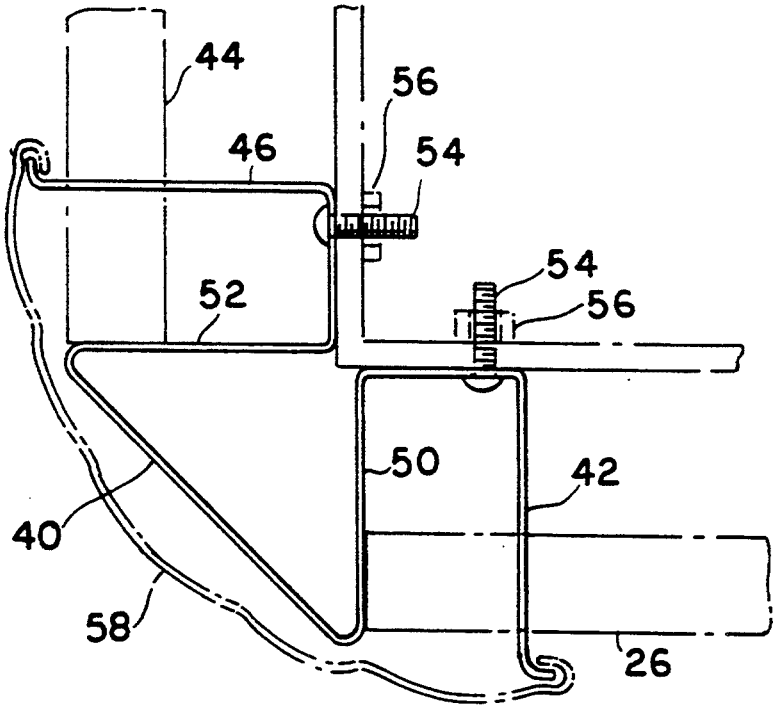
FIG. 6 is a fragmentary perspective view of a casket with the supporting hardware in place and decorative hardware associated therewith and at the casket corners covering the ends of the bars.
Figure 7:
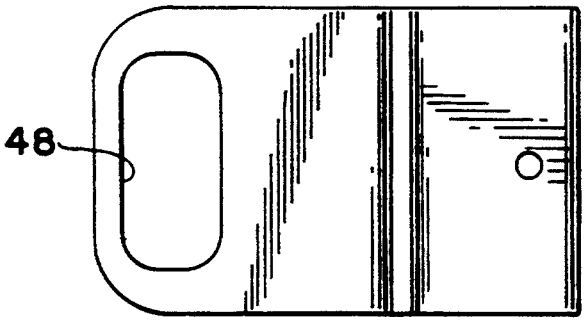
FIG. 7 is an end view of the corner lug.

Referring initially to FIG. 3–5, the hardware providing the support and connection for the bar to the casket sidewalls will include at least two side lugs 10 preferably made of stamped and formed sheet metal. Each side lug includes a base 12 bent to provide a central arch 14 and which is provided with a central opening 16. From the base 12 extends outwardly two upstanding legs or arms 18 and 20. The legs are formed with openings 22 and 24, respectively; for receiving bar 26.

In assembling the bar 26 to the casket side 28, the bar is placed in openings 22 and 24 of side lug 10 either before or after the lug is preliminarily mounted on casket side 28 by bolt 30 and nut 32. As a result the arch 14, further tightening of the nut and bolt will cause the arms 18 and 20 to flex causing them to bite into the bar 26 and thereby secure the bar against lateral movement. Decorative hardware 34 may then be clipped or otherwise secured to the free ends of the arms 18 and 20. This hardware inasmuch as it no longer needs to be load supporting may be made of relatively thin, less costly materials of plastic or sheet metal that is suitably configured to provide the desired ornamental and aesthetic effects.

The free ends of the bars may simply be associated with decorative hardware or as shown may have bar supporting corner lugs 40 coupled therewith. It should be understood that this invention also contemplate the utilization of corner lugs alone as well as with the side lugs 10 for support of bars 26. The corner lug 40 may be of stamped and formed sheet metal and provided with an arm 42 and if an end bar 44 is to be used, another arm 46. Each arm 42 and 46 is formed with an opening 48 for receiving the end of the associated bar. The lug 40 is also formed with walls 50 and 52 for strength purposes as well as providing a surface against which the end of the associated bar rests against or can engage with the prevent lateral movement of this bar. A pair of bolts 54 and nuts 56 connect the lug 40 to the corners of the casket. Decorative hardware 58 similar to hardware 34 may be applied over lug 40 and may be clipped or otherwise connected with the arms 42 and 46.

Thus, the several aforenoted objects and advantages are most effectively attained. Although several somewhat preferred embodiment of the invention has been disclosed and described in detail herein, it should be noted that this invention is in no sense limited thereby and its scope is to be determined by that of the appended claims.

What is claimed is:

1. A stationary bar hardware system comprising in combination:

a side lug for connection with a wall of a casket, the lug including an arch shaped base for securement to the wall of the casket and a pair of spaced arms extending outwardly from the base, each arm having an opening for receiving a bar, whereby upon flattening of the arch shaped base upon securement of the base to the casket wall, the arms bite into the bar to secure it against lateral movement, the arms being provided with means for coupling with decorative hardware.

2. The invention according to claim 1 wherein a corner lug is provided for connection with a corner of the casket, the lug having at least one arm having an opening for receiving and supporting a bar, and at least one spaced wall against which the end of the bar is adapted to engage to cooperate in preventing lateral movement of the bar.

3. The invention according to claim 2 wherein another of such arm and spaced wall is provided, one arm and wall is associated with an end of a bar extending along the side of the casket and another of the arm and wall is associated with an end of a bar extending along an end of the casket.

4. A stationary bar hardware system comprising in combination:

a corner lug for connection with a corner of the casket, the lug having at least one arm having an opening for receiving and supporting a bar, and at least one spaced wall against which the end of the bar is adapted to engage to cooperate in preventing lateral movement of the bar;

another of such arm and spaced wall being provided, one arm and wall being associated with an end of a bar extending along the side of the casket and another of the arm and wall being associated with an end of a bar extending along an end of the casket, the arms being provided with means for coupling with decorative hardware; and separate decorative hardware coupled with the arms.

5. A casket having a base, top, ends and opposed sides, a stationary bar on each of the opposed sides and at least two spaced stationary bar hardware system coupling each bar to the casket side, each stationary bar hardware system comprising in combination:

a side lug for connection with the wall of a casket, the lug including an arch shaped base for securement to a wall of the casket and a pair of spaced arms extending outwardly from the base, each arm having an opening for receiving a bar, whereby upon flattening of the arch shaped bore upon securement of the base to the casket wall, the arms bite into the bar to secure it against lateral movement, the arms being provided with means for coupling with decorative hardware.

6. The invention according to claim 5 wherein is provided corner lug for connection with a corner of the casket, the lug having at least one arm having an opening for receiving and supporting a bar, and at least one spaced wall against which the end of the associated bar rests or can engage to prevent lateral movement of the bar.

7. The invention according to claim 6 wherein another of such arm and spaced wall is provided, one arm and wall is associated with an end of a bar extending along the side of the casket and another of the arm and wall is associated with an end of a bar extending along an end of the casket.

8. A casket having a base, top, ends and opposed sides, a stationary bar on each of the opposed sides and at least two spaced stationary bar hardware system coupling each bar to the casket side, each stationary bar hardware system comprising in combination:

a side lug with connection with a wall of a casket, the lug including an arch shaped base for securement to the wall of the casket and a pair of spaced arms extending outwardly from the base, each arm having an opening for receiving a bar, whereby upon flattening of the arch shaped base upon securement of the base to the casket wall, the arms bite into the bar to secure it against lateral movement, a corner lug for connection with a corner of the casket, the lug having at least one arm having an opening for receiving and supporting a bar, and at least one spaced wall against which the end of the associated bar rests or can engage to prevent lateral movement of the bar, the arms being provided with means for coupling with decorative hardware.

9. The invention according to claim 8 wherein another of such arm and spaced wall is provided, one arm and wall is associated with an end of a bar extending along the side of the casket and another of the arm and wall is associated with an end of a bar extending along an end of the casket.

* * * * *